US008410520B2

(12) United States Patent
Penumatcha et al.

(10) Patent No.: US 8,410,520 B2
(45) Date of Patent: Apr. 2, 2013

(54) RUGGED REGISTERED JACK CONNECTION

(75) Inventors: Raju Penumatcha, Plano, TX (US); Vince Wouters, McKinney, TX (US)

(73) Assignee: Applied Optical Systems, Inc., Plano, TX (US)

( * ) Notice: Subject to any disclaimer, the term of this patent is extended or adjusted under 35 U.S.C. 154(b) by 0 days.

(21) Appl. No.: 13/226,494

(22) Filed: Sep. 7, 2011

(65) Prior Publication Data

US 2012/0115360 A1 May 10, 2012

Related U.S. Application Data

(63) Continuation of application No. 12/819,978, filed on Jun. 21, 2010, now abandoned.

(60) Provisional application No. 61/218,869, filed on Jun. 19, 2009.

(51) Int. Cl.
*H01R 24/00* (2011.01)

(52) U.S. Cl. ..... 257/166

(58) Field of Classification Search ..... 439/676, 439/638, 66, 941, 628
See application file for complete search history.

(56) References Cited

U.S. PATENT DOCUMENTS

| | | | | |
|---|---|---|---|---|
| 5,535,274 | A * | 7/1996 | Braitberg et al. | 379/446 |
| 6,793,540 | B2 * | 9/2004 | Peng | 439/722 |
| 7,326,073 | B2 * | 2/2008 | Hanning et al. | 439/344 |
| 7,338,327 | B2 * | 3/2008 | Sticker et al. | 439/638 |
| 7,442,081 | B2 * | 10/2008 | Burke et al. | 439/589 |
| 2006/0166563 | A1 * | 7/2006 | Osypka | 439/668 |

* cited by examiner

*Primary Examiner* — Tulsidas C Patel
*Assistant Examiner* — Phuongchi Nguyen

(57) ABSTRACT

Systems and methods are disclosed that include a first registered jack and a junction coupled to the first registered jack. These systems and methods also include a first source unit connected to the junction and a first layer encasing at least part of the first registered jack, the junction, and the first source unit. In addition, these systems and methods include an o-ring preventing surrounding the first layer and a housing encasing the first layer and the o-ring.

19 Claims, 6 Drawing Sheets

RUGGED REGISTERED JACK CONNECTION

CROSS-REFERENCE TO RELATED APPLICATIONS

This application is a continuation of U.S. Ser. No. 12/819,978 filed on Jun. 21, 2010 now abandoned, which claims priority under 35 U.S.C. Section 119(e) to U.S. Provisional Patent Application No. 61/218,869, filed Jun. 19, 2009, which are hereby incorporated by reference.

TECHNICAL FIELD OF THE INVENTION

The present invention relates to the connections of terminals and, in particular, to creating rugged registered jack (RJ) connections.

BACKGROUND

Registered jack (RJ) connections, such as the Ethernet RJ45, are used to connect a plurality of electronic devices. These devices are used in various different forms to connect a variety of types of devices. For instance, RJ45 connects are commonly used to connect Ethernet devices.

One of the problems of RJ connections is the difficulty in using these delicate devices in high stress fields. Systems and methods that could be used to project RJ connections are needed.

SUMMARY

In one embodiment, an apparatus is disclosed that includes a first registered jack and a junction coupled to the first registered jack. This system also includes a first source unit connected to the junction and a first layer encasing at least part of the first registered jack, the junction, and the first source unit. In addition, this system includes an o-ring preventing surrounding the first layer and a housing encasing the first layer and the o-ring.

In another embodiment, a method is disclosed that includes creating a connection between two different aligned terminals in a connector. In this method, the first terminal and second terminal form a junction to transmit data. The connection is enclosed in a first layer made up of an epoxy material. This first layer is enclosed in a second layer that is used to prevent the exposure of the connection to outside elements using at least one o-ring. This method also includes maintaining the connection between the two different terminals and using at least one feature of the second layer to position the connection.

In yet another embodiment, a system is disclosed that includes a first registered jack coupled to a junction and a first source coupled to the junction. The junction is used to couple the first registered jack to the first source. This system also includes a first layer encasing at least part of the first registered jack, the junction, and the first source unit. In addition, this system also includes an o-ring preventing moisture from entering at least part of the first layer surrounding the first layer and a ruggedized housing enclosing the first layer.

BRIEF DESCRIPTION OF THE DRAWINGS

For a more complete understanding of the present invention, and the advantages thereof, reference is now made to the following descriptions taken in conjunction with the accompanying drawings, wherein like numbers designate like objects, and in which.

DETAILED DESCRIPTION OF THE INVENTION

It may be advantageous to set forth definitions of certain words and phrases that may be used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller might be centralized or distributed, whether locally or remotely.

Physical cables may be used to transmit both power and information. These physical cables are generally made up of a plurality of segments connected together through junctions. At junctions where a first terminal is connected to a second terminal, a connection is required. The advantage of a registered jack connection is that it promotes a consistent connection between the first terminal and the second terminal with transmission mediums such as light, waves, or power. The disadvantage of such a connection is that any force applied to the connection may result in damage to the physical cable connected by the junction. There exists a need for a ruggedized connection between registered jack connections.

A registered jack (RJ) refers to a standardized physical interface. This standardized physical interface includes both a physical, optical, magnetic, or other interface capable of relaying a signal or wave and a pattern of connections. It can connect a plurality of physical connections. Examples of registered jacks include, but are not limited to RJ-45 (ethernet), RJ-11 (telephone line), RJ-49 (Integrated Services Digital Network), universal serial bus (USB), digital video interface (DVI), high definition multimedia interface (HDMI), and any custom configuration of connections that have been defined. It is expressly contemplated that any kind of RJ may be used consistent with the present disclosure.

Figure 1:
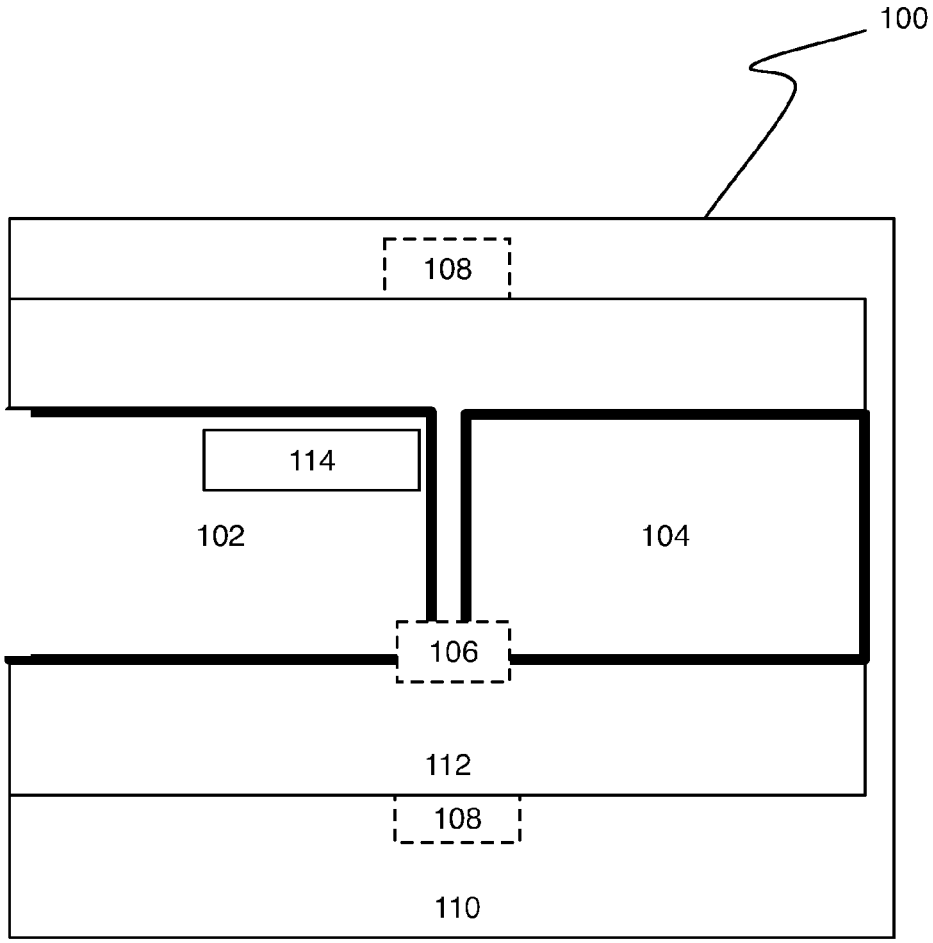
FIG. 1 is a cross section of a rugged RJ connection, according to an embodiment of this disclosure.

An embodiment of a rugged RJ connection 100 is depicted in FIG. 1. In FIG. 1, a first terminal 102 is shown prior to connection to the second terminal 104 that is in a sealed second layer 112 surrounded by a first layer 110. The first terminal 102 is connected to the second terminal 104 through a junction 106. Surrounding the first terminal 102 and the second terminal is a seal 108. This seal 108 is used as an inner sealing internal to the first layer 110. This connection, as will be disclosed through a plurality of examples that follow, allows for a consistent, ruggedized connection between the first terminal 102 and the second terminal 104. It is understood that the first terminal 102 may be open to external connections while the second terminal 104 may be sealed.

It is understood that a plurality of RJ connections may be in a rugged RJ connection 100. It is further understood that these plurality of connections may be in any configuration, number or order. It is further understood that a single RJ jack may be connected to a plurality of connections. For instance, a single first terminal 102 may connect to a plurality of RJ connections in the second terminal 104. The present disclosure contemplates any number of connections made between any numbers of RJ connections.

The first layer 110 is intended to be the outer layer of the rugged RJ connection 100. The first layer 110 may be comprised of plastic, metal, silicone, or other material. The first layer 110 may provide a protective outer layer for the second layer 112. The first layer 110 may be shaped into any configuration with exterior features including, but not limited to, threads. The positioning of features on the second layer, such as threads, holes, bolts, inserts, connectors, or other features allow for the positioning of the rugged RJ connection 100.

The second layer 112 is used to seal the first terminal 102, second terminal 104, and the junction 106. The second layer 112 may be made of epoxy, silicon, or other material. In some preferred embodiments, the second layer may be made of any non-conducting material. The second layer is intended to encase the first terminal 102, second terminal 104 and the junction 106. The second layer 112 creates a barrier that prevents the movement of materials including air, moisture, gases, or other materials, from the first terminal 102 to the second terminal 104 and vise versa. The second layer 112 can, in some embodiments, also create a barrier that prevents the movement of waves, signals, or energy from leaving rugged RJ connection 100.

The seal 108 is used to seal the inside of the second layer 112. One of the innovative features of the present disclosure is the use of the seal 108 to seal the inside of the second layer 112 from the outside environment. In some embodiments, the first terminal 102 is exposed to the area on the "outside" of the rugged RJ connection 100 and the second terminal 104 is within a closed area. For example, in one embodiment, the rugged RJ connection 100 may be placed in a vehicle where the first terminal 102 is accessible from "outside" of the vehicle and the second terminal 104 is enclosed with an electrical device, such as a computer. One of the advantages of the present disclosure is the use of the seal 108 to prevent materials from reaching the closed area. Therefore, even in adverse conditions, moisture, sand, or other undesirable substances would be unable reach the closed area as the seal 108 creates a barrier between the "inside" and the "outside".

The seal 108 prevents moisture from reaching the second terminal 104 and the junction 106. The seal 108 may be implemented in any way known to one skilled in the art, including, but not limited to, as an o-ring, a washer, a rubber seal, or other physical seal. In some cases, the seal may be implemented as a barrier to radiation, energy, signals, or any other energy to pass through. The selection of the specific material to use for the seal 108 is based upon the environment in which the rugged RJ connection 100 is to be used.

It is expressly understood that the first terminal 102 may be replaced with wired connection to junction 106. In such a case, the first terminal 102 will be replaced with a wired connection.

Junction 106 is contemplated to be any device, connection, system or unit capable of creating an electrical, mechanical, optical, or electro-magnetic pathway between the first terminal 102 and the second terminal 104. Junction 106 may be implemented onto a circuit board or other device. Junction 106 may be used to connection any number of RJ connections with any number of individual connections within the RJ connections. In some embodiments, the junction 106 may have specific hardware to facilitate the number of connectivity of the first terminal 102 and the second terminal 104. For instance, in one embodiment where the RJ are USB connections, a hub may be embedded into the junction 106 allowing a plurality of devices to connect to the first terminal 102 even with only one connection to the second terminal 104.

In addition, junction 106 may be further configured to provide translation between different types of connections. For instance, in one embodiment, the first terminal 102 may be a USB port and the second terminal 104 may be a RJ45 port. Junction 106 may be configured to provide a connection between the two disparate types of ports.

It is further understood that a cover may, in some embodiments, be used to cover the open terminal.

It is understood that terminals 102 and 104 may comprise male or female connectors. For instance, a male adapter 114 is shown in FIG. 1 as an optional connector within first terminal 102. It is contemplated that terminals 102 and 104 may be both male, both female, and one may be male and one may be female.

While the example of a RJ jack is shown through terminals 102 and 104, it is further understood that terminals 102 and 104 may be used in a variety of communication connections, including, but not limited to fiber optic connections. The systems and methods disclosed herein, include those with an inner o-ring internal to any kind of receptacle, are expressly contemplated.

It is contemplated that the embodiment disclosed in FIG. 1 may be made in any way known to one skilled in the art. In one example, a hollow holder is obtained that comprises a first keystone, a second keystone, and a Printed circuit board (PCB) board with leads connecting the first and second keystone. The hollow holder may be any shape and size, and may be broken into any number of pieces while the embodiment disclosed in FIG. 1 is created. The first keystone is used in the first terminal 102, the second keystone is used in the second terminal 104, and the PCB board is used as the junction 106. The two keystones are placed into the hollow holder with the PCB board, and a liquid, such as a liquid silicon rubber, is injected into the hollow container. The liquid hardens on the outside of the keystones within the hollow layer forming the substantially homogenous layer 112. The substantially homogenous layer 112 may then be inserted into a housing, as discussed below.

Figure 2:
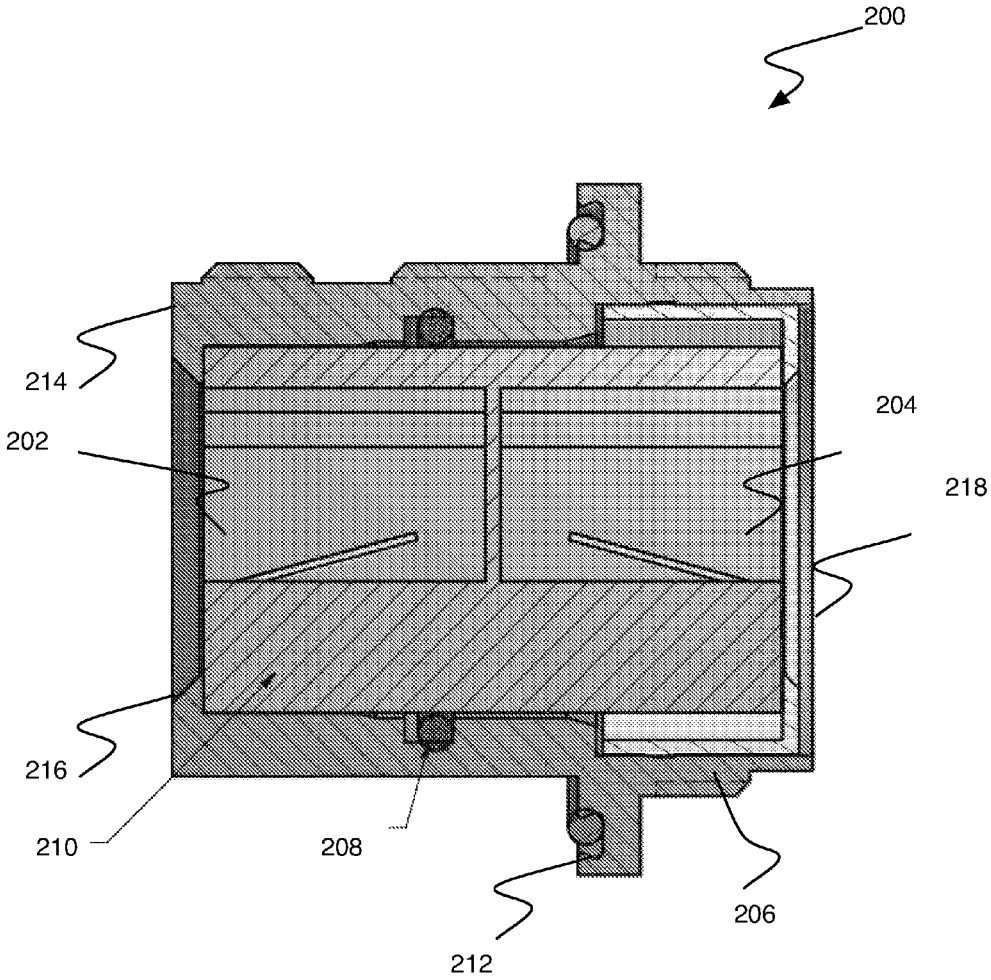
FIG. 2 is a cross section of an rugged RJ connection with a second o-ring, according to an embodiment of this disclosure.

FIG. 2 is cross section of a second embodiment 200 of the present disclosure. FIG. 2 shows a first terminal 202, second terminal 204, a first layer 206, a second layer 210, a o-ring 208 and a second o-ring 212. FIG. 2 is substantially similar to FIG. 1, except that the first layer 206 has been shaped and is connected to the second o-ring 212. The second o-ring 212 is used to prevent moisture when the second embodiment 200 is placed into a housing or connected to a cover to prevent moisture from entering the inner chamber.

Figure 3:
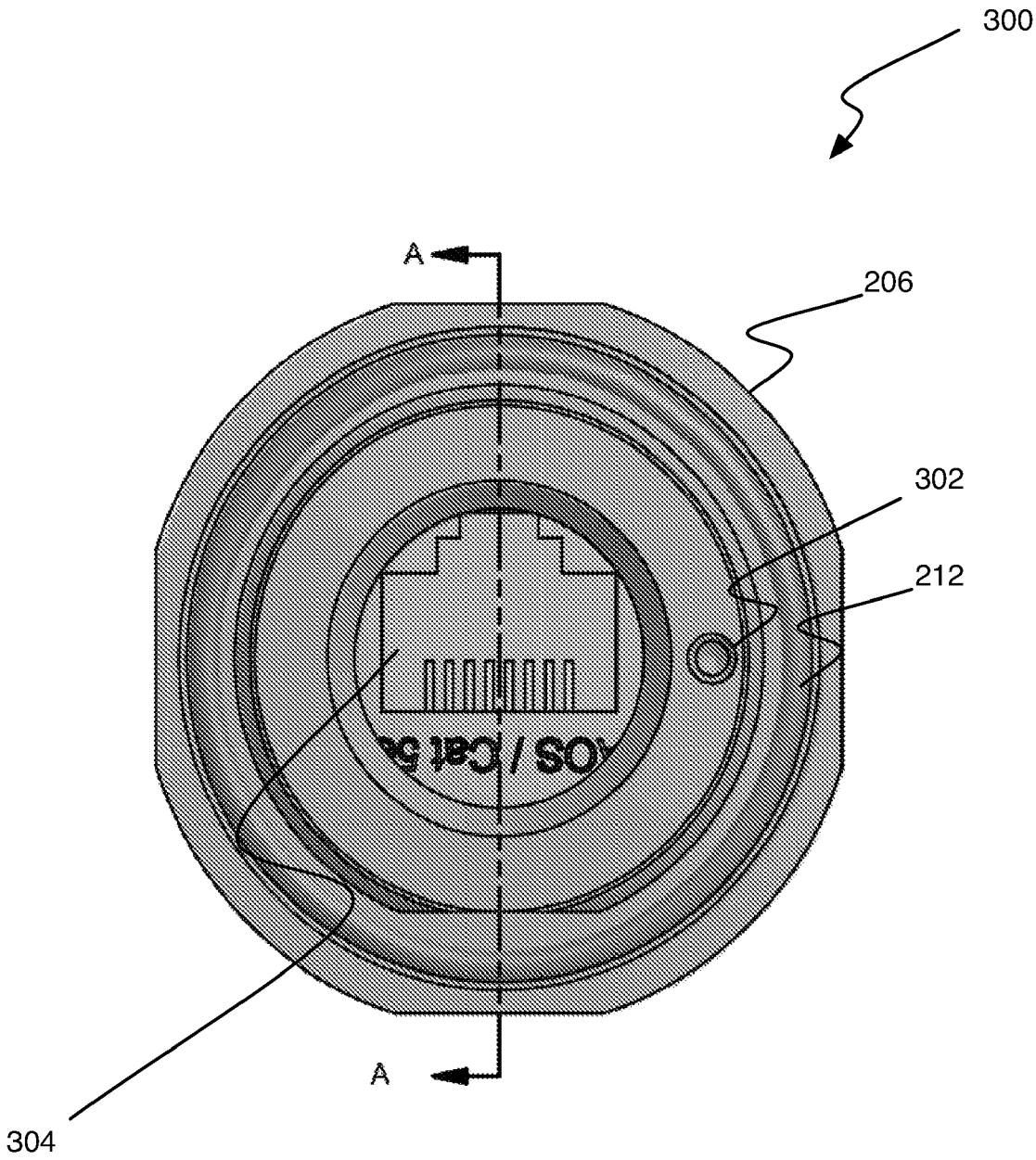
FIG. 3 is top view of an RJ connection, according to an embodiment of this disclosure.

FIG. 3 is another view 300 of the second embodiment 200 shown in FIG. 2. In this view, the first layer 206 and the second o-ring 212 are shown. In addition, this embodiment shows a chamfer 302 within the first layer 206. This chamfer may be used as a guide or to otherwise facilitate the usage of the rugged RJ connection.

The first layer may be configured in a plurality of ways to form a plurality of receptacles. These receptacles include, but are not limited to, a flange mount, a jam nut, and an in-line connection. These example configurations are shown for illustrative purposes only, and it is expressly contemplated that any configuration may be used.

While the illustration shown in various figures, including FIG. 3, represents a circular connection, it is expressly contemplated that any shape including, but not limited to, a square, rectangle, hexagon, or other shape may be used to create the connection. The present disclosure should not be construed as to be limited to a particular shape.

Figure 4A:
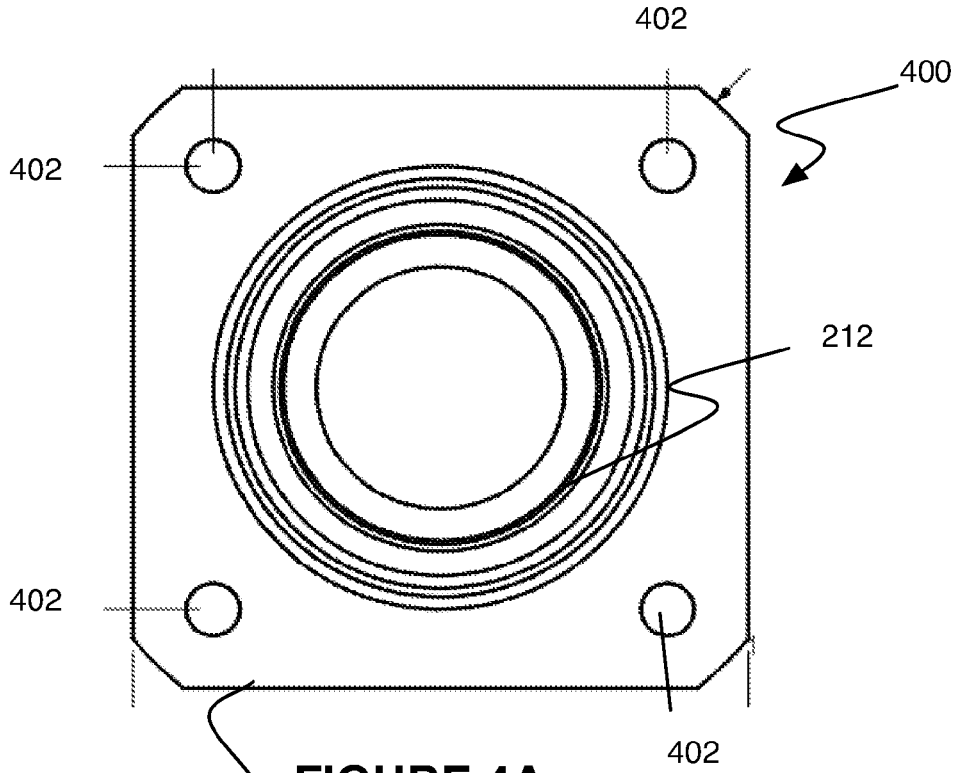
FIG. 4A and FIG. 4B are an example of the use of a flange mount configuration, according to an embodiment of this disclosure.
Figure 4B:
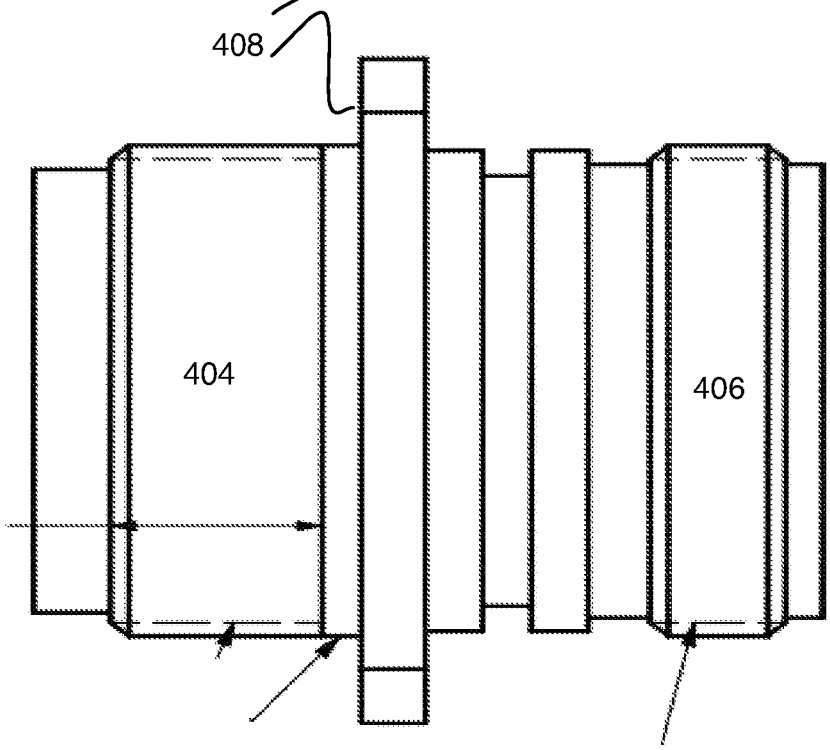

FIG. 4A and FIG. 4B are an example of the use of a flange mount configuration 400 consistent with the present disclosure. FIG. 4A shows a top view of the flange mount configuration and FIG. 4B shows a side view of the flange mount configuration. In FIG. 4A mounting holes 402 are shown. It is understood that the position, dimensions, and the number of mounting holes 402 may change based upon the application. While a chamfer is not shown in FIG. 4A, it expressly understood that one can be added to any part of the flange mount configuration 400, but preferably within the area enclosed by the second o-ring 212.

FIG. 4B shows a side view of the flange mount configuration. In this view, a number of threads may be placed, etched, or otherwise situated on faces 404 and 406. These threads may be any kinds of threads that promote the connection of the flange mount configuration 400 with another device.

Figure 5A:
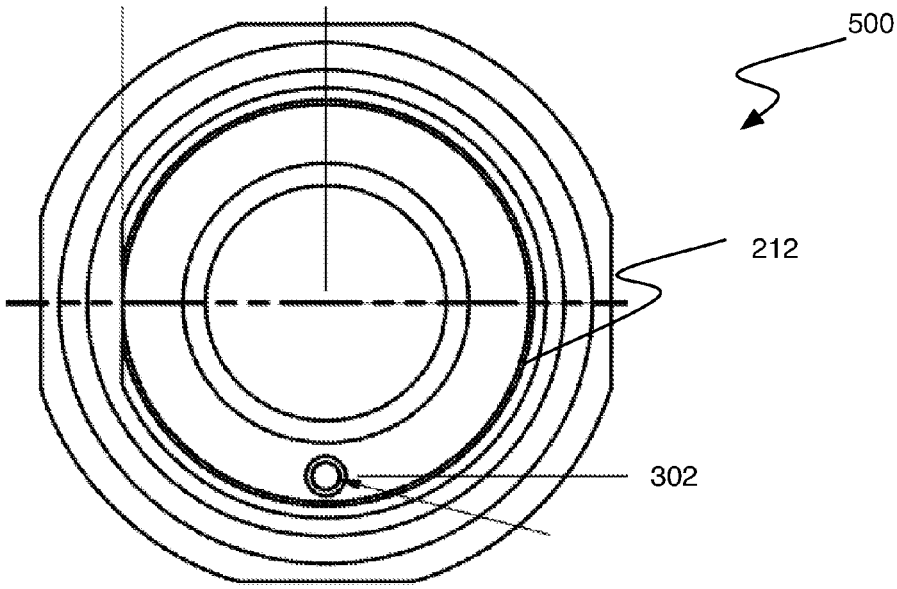
FIGS. 5A and 5B are an example of the use of a jam nut configuration, according to an embodiment of this disclosure.
Figure 5B:
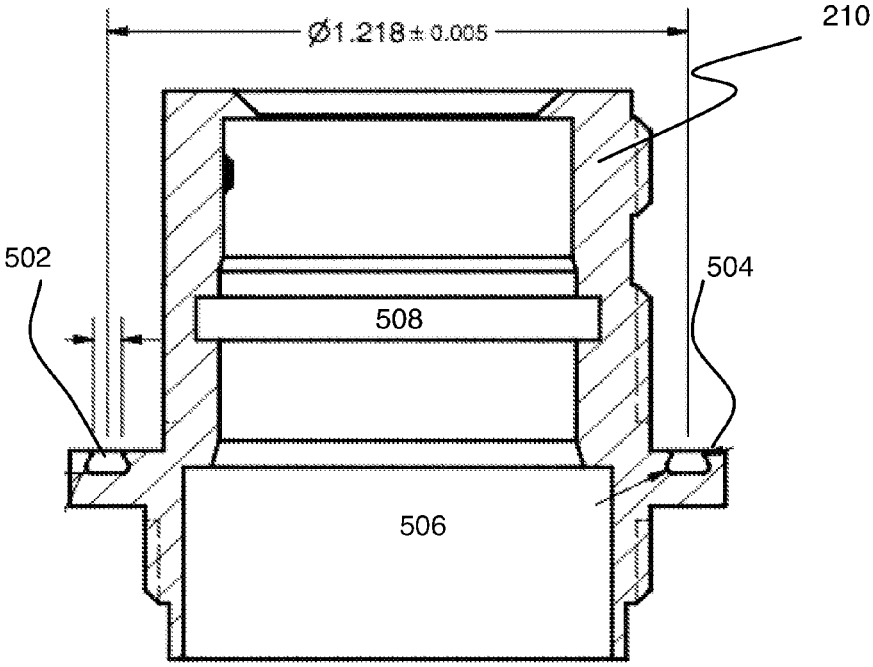

FIGS. 5A and 5B are an example of the use of a jam nut configuration 500 consistent with the present disclosure. A jam nut is used as a type of locknut. FIG. 5A is substantially similar to FIG. 4A showing the second o-ring 212 and the chamfer 302.

In the jam nut configuration 500, a first jam nut receptacle 502 and a second jam nut receptacle 502 are shown in FIG. 5B. FIG. 5B also shows two faces 506 and 508 where threads may be used and in addition second layer 210 is also shown.

Figure 6A:
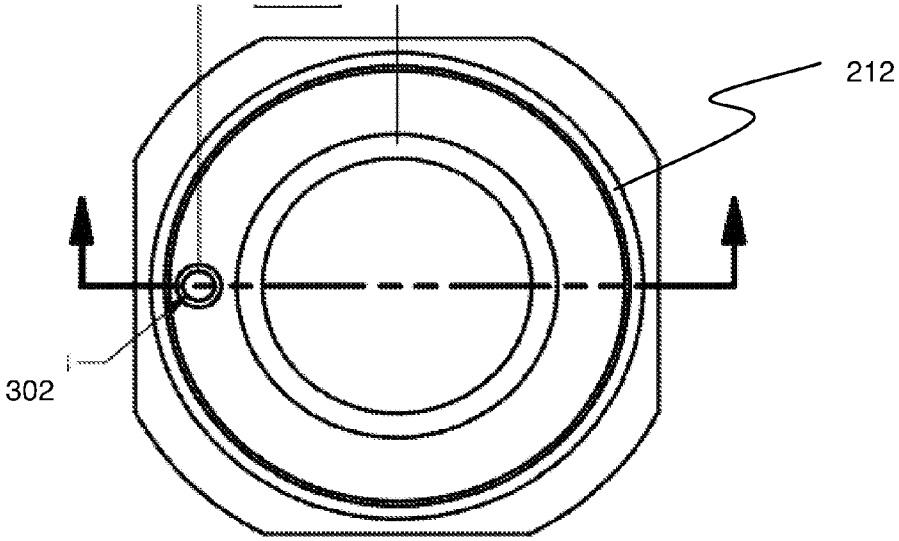
FIGS. 6A and 6B are an example of the use of an in-line configuration, according to an embodiment of this disclosure.
Figure 6B:
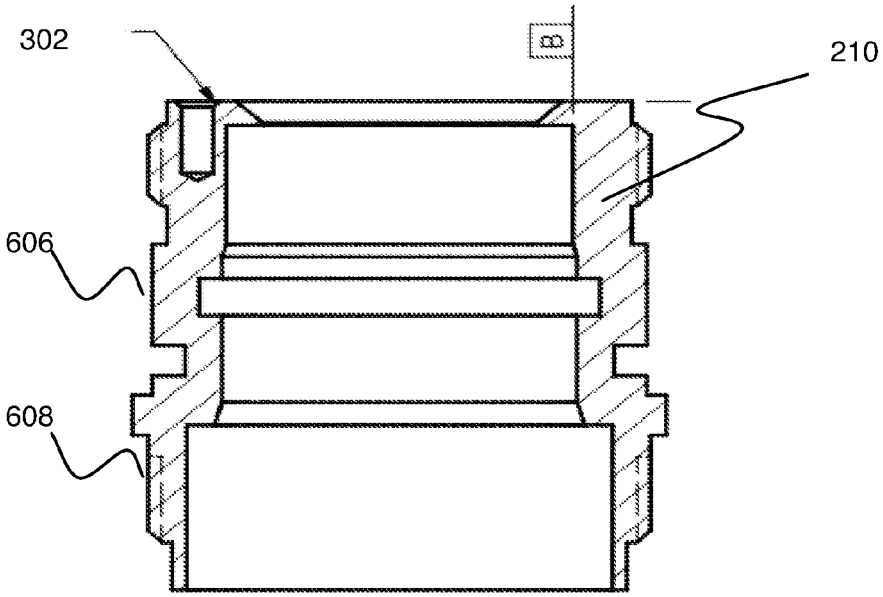

FIGS. 6A and 6B are an example of the use of an in-line configuration 600 consistent with the present disclosure. FIG. 6A is substantially similar to FIG. 5A showing a chamfer 302 and a second o-ring 212.

In the in-line configuration 600, there can be threads attached to areas 606 and 608 as shown in FIG. 6B. FIG. 6B also shows the second layer 210.

Although the present invention and its advantages have been described in the foregoing detailed description and illustrated in the accompanying drawings, it will be understood by those skilled in the art that the invention is not limited to the embodiment(s) disclosed but is capable of numerous rearrangements, substitutions and modifications without departing from the spirit and scope of the invention as defined by the appended claims.

What is claimed is:

1. A connector, comprising:
an outer housing;
a first registered jack keystone positioned within the outer housing;
a second registered jack keystone positioned within the outer housing;
a junction positioned within the outer housing and coupling the first registered jack keystone to the second registered jack keystone;
an inner housing positioned within the outer housing and operable for encasing the first registered jack keystone, the second registered jack keystone and the junction, and wherein the inner housing comprises silicon rubber and is substantially homogenous; and
a seal operable for creating a barrier between the inner housing and the outer housing.

2. The connector in accordance with claim 1 wherein the first and second registered jack keystones each comprise an RJ45 jack.

3. The connector in accordance with claim 1 wherein the seal comprises an o-ring.

4. The connector in accordance with claim 1 wherein the outer housing comprises exterior threads.

5. The connector in accordance with claim 1 wherein the outer housing comprises conductive material and the inner housing comprises non-conductive material.

6. The connector in accordance with claim 1 wherein the first registered jack keystone comprises a universal serial bus port.

7. A rugged registered jack connector, comprising:
an outer housing having a circular shape;
a registered jack keystone disposed within the outer housing;
a terminal disposed within the outer housing
a junction disposed within the outer housing and coupling the registered jack keystone to the terminal;
a first layer of material encasing at least part of the registered jack keystone, the terminal and the junction, and wherein the first layer of material comprises silicon rubber and is substantially homogenous; and
a seal disposed between the first layer of material and the outer housing.

8. The connector in accordance with claim 7 wherein the registered jack keystone comprises an RJ45 jack.

9. The connector in accordance with claim 7 wherein the seal comprises an o-ring.

10. The connector in accordance with claim 7 wherein the outer housing comprises exterior threads.

11. The connector in accordance with claim 7 wherein the outer housing comprises conductive material and the first layer of material comprises non-conductive material.

12. The connector in accordance with claim 7 wherein the registered jack keystone comprises a universal serial bus port.

13. A registered jack connector, comprising:
an outer housing having a circular shape;
a registered jack keystone disposed within the outer housing, the registered jack keystone having a rectangular shape;
a terminal disposed within the outer housing
a junction disposed within the outer housing and coupling the registered jack keystone to the terminal;
a first layer of material encasing at least part of the registered jack keystone, the terminal and the junction, the first layer of material having a circular outer shape substantially similar to the circular shape of the outer housing; and
a seal disposed between the first layer of material and the outer housing.

14. The connector in accordance with claim 13 wherein the registered jack keystone comprises an RJ45 jack.

15. The connector in accordance with claim 13 wherein the seal comprises an o-ring.

16. The connector in accordance with claim 13 wherein the outer housing comprises exterior threads.

17. The connector in accordance with claim 13 wherein the registered jack keystone comprises a universal serial bus port.

18. The connector in accordance with claim 13 wherein the outer housing comprises conductive material and the first layer of material comprises non-conductive material.

19. The connector in accordance with claim 18 wherein the first layer comprises at least a one of epoxy and silicone rubber.

* * * * *